US005685187A

United States Patent [19]

Bindernagel et al.

[11] Patent Number: 5,685,187

[45] Date of Patent: Nov. 11, 1997

[54] ARRANGEMENT FOR INCLINED ROLLING OF TUBE- AND BAR-SHAPED ROLLING ARTICLES

[75] Inventors: Ali Bindernagel, Wermelskirchen; Albert Quambusch, Meerbusch; Wilfried Schoeneberg, Duesseldorf, all of Germany

[73] Assignee: Kocks Technik GmbH & Co., Hilden, Germany

[21] Appl. No.: 617,287

[22] Filed: Mar. 18, 1996

[30] Foreign Application Priority Data

Mar. 24, 1995 [DE] Germany ..... 195 10 721.7

[51] Int. Cl.[6] ..... B21B 13/00

[52] U.S. Cl. ..... 72/78

[58] Field of Search ..... 72/78

[56] References Cited

U.S. PATENT DOCUMENTS 4,457,152 7/1984 Svagr ..... 72/78

FOREIGN PATENT DOCUMENTS 3113461 4/1981 Germany .

*Primary Examiner*—Lowell A. Larson

*Attorney, Agent, or Firm*—Michael J. Striker

[57] ABSTRACT

An arrangement for inclined rolling of tube-and bar-shaped rolling articles has two or more driven rollers rotatable about a longitudinal axis of a rolling article and supported in or on a rotor which surrounds the rolling article. The rotor is arranged in a stationary housing which is closed from all sides to provide a compact and efficient arrangement allowing an especially high rotary speed. Moreover, the arrangement with the inclined rollers rotatable about the longitudinal axis of the rolling product allow a fast exchange of the whole arrangement by a pre-assembled second arrangement so that stoppage of the whole arrangement during a roller exchange or a change in the roller adjustment is substantially reduced.

8 Claims, 4 Drawing Sheets

ARRANGEMENT FOR INCLINED ROLLING OF TUBE- AND BAR-SHAPED ROLLING ARTICLES

BACKGROUND OF THE INVENTION

The present invention to an arrangement for inclined rolling of tube-and bar-shaped rolling articles.

More particularly, it relates to an arrangement for rolling of the above mentioned articles, which has two or more driven rollers rotatable about a rolling article longitudinal axis and supported in or on a rotatable rotor which surrounds the rolling article.

Arrangements of the above mentioned general type are known in the art. One of such arrangements is disclosed for example in the German patent document DE-OS 31 13 461. This arrangement has a stationary housing part and a rotor which is located on the housing part and rotatable on an end side during the operation. The rotor is accessible from outside. It contains three roller shafts which are arranged inclinedly to the longitudinal axis of the rolling article and have bearings provided in each bevel gear transmission stage for each of the three roller shafts and total six further toothed gears as well as their shafts and bearings, and the drive rotary movement of a sun gear and the rotary movement of the rotor are provided and transferred to the rollers. The rotor has devices required for adjusting of the rollers, including operational elements for these devices. The drive elements for the sun gear and for the rotor as well as the bearings of both are arranged in the stationary housing part.

The above mentioned arrangement has an expensive construction and manufacture. Complicated individual components make the manufacture expensive and increase the operational costs since they require intensive repairs and they are susceptible to wear. For example the bearings arranged in the rotatable rotor and the toothed gear transmission stages are lubricated from the stationary housing, that is possible only through oil passages and conduits which extend in a complicated way and are difficult to be sealed from outside. For ensuring a sufficient lubrication, not only oil and oil supply is necessary, but also special oil repair conduits and passages must be provided in an oil circulation. For oil supply and withdrawal it is necessary to provide bridging elements between the stationary housing part and the rotor which further increase the structural and manufacturing cost. Moreover, in the known construction, not only the rollers, but also the whole rotor is supported in floating manner. This results in high rotating masses of the rotor which leads to an unquiet running and therefore the maximum rotary speed is limited and the rolling article throughput and the efficiency of the arrangement are limited as well. Furthermore, the relatively fast rotatable rotor is directly accessible from outside and therefore forms during the operation a danger for personnel of accidental contact or throwing of defective or loosened components.

SUMMARY OF THE INVENTION

Accordingly, it is an object of the present invention to provide an arrangement for inclined rolling of tube and bar-shaped rolling articles, which avoids the disadvantages of the prior art.

More particularly, it is an object of the present invention to provide an arrangement for inclined rolling of tube and bar-shaped rolling articles, which has a simpler and safer construction and at the same time provides a higher efficiency.

In keeping with these objects and with others which will become apparent hereinafter, one feature of the present invention resides, briefly stated, in an arrangement of the above mentioned general type in which the rotor is arranged in a stationary housing which is closed from all sides and released only the region of the rollers at an end side, and the rotor is supported rotatably in the openings of this housing.

When the arrangement is designed in accordance with the present invention, the previous difficulties in the construction and manufacture of the arrangement are avoided, since all conduits and passages for a return of the lubricating oil can be dispensed with and therefore individual parts which are complicated, expensive and require repair are dispensed with as well. The lubricating oil can be injected in the completely closed housing from lubricating points freely into the inner chamber of the housing, is collected and supplied to oil supply devices. Moreover, such a closed, stationary housing provides substantial improved support for rotor with its relatively great rotatable mass, so that a quieter running and increased rotary speed can be obtained, which as a result substantially increases the material throughput per time unit and thereby the efficiency of the arrangement. Furthermore, the stationary housing closed at all sides substantially improves the safety of the arrangement. The rotatable rotor can be no longer contacted by personnel and the personnel is protected from eventually flying parts such as broken screws or nuts. The arrangement can be used without additional protective hood as in the known constructions.

In accordance with a further advantageous feature of the present invention the housing surrounds, in addition to the rotor, also its driving elements as well as the driving element of the roller. As a result a single stationary housing is provided in this way, in which, with the exception of the rollers, practically all movable parts are contained. This leads to a compact construction of the arrangement and provides an unobjectionable support of all rotatable supports which cannot be reached from outside during the operation.

It is also recommended, in accordance with a further feature of the present invention, when the rotor with its end portion facing the rollers is rotatably supported in an end wall and with its end portion facing away from the rollers is rotatably supported in another wall of the housing. In this way both-sides supported rotor is provided, which substantially reduces the loading of the individual supporting units so that the higher rotary speeds can be achieved. In this construction at the second point of the above mentioned other wall for receiving the second bearing, no outer wall must be provided in the stationary housing but instead an intermediate wall can perform this function.

It is especially advantageous when the housing has placing surfaces, orienting surfaces and clamping surfaces with which it is insertable into a base, orientable to the rolling line and clampable on the base. The housing and the parts supported in it can be easily released in this case from the base and removed from the rolling line and exchanged by a second housing of this type. It is recommended that the housing be provided with suspending devices for a crane and therefore is easily transportable. Moreover, it is advisable to make the base as a movable exchange car or to arrange it on such an exchange car and to move both together with the housing in the rolling line in and out. The use of an exchange car has the advantage that for exchanging of the housing and the parts supported in it, including the rollers, girder cranes are not needed and the exchange can be performed at any time without difficulties. The transportable and easily exchangeable construction of the arrangement of the housing substantially reduces the production interruptions when the rolling article with other cross-sectional dimensions must be rolled and/or a wear of the rollers occurs.

The required adjusting works and required exchange of the rollers does not have to be performed in the rolling line, which usually required a long time, but instead in the inventive arrangement this can be performed during rolling so that another housing is prepared in a neighboring work station and can be then exchanged. The other housing can be new or reused and can contain other rollers adjusted to the cross-sectional dimensions of the rolling articles. Thereby for the first time in the inventive arrangement with inclined rollers rotating about the rolling article a fast roller exchange and exchange of the dimensions of the rolling article can be performed in a shortest possible time, which substantially improves the efficiency of the total arrangement during short stoppage time.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
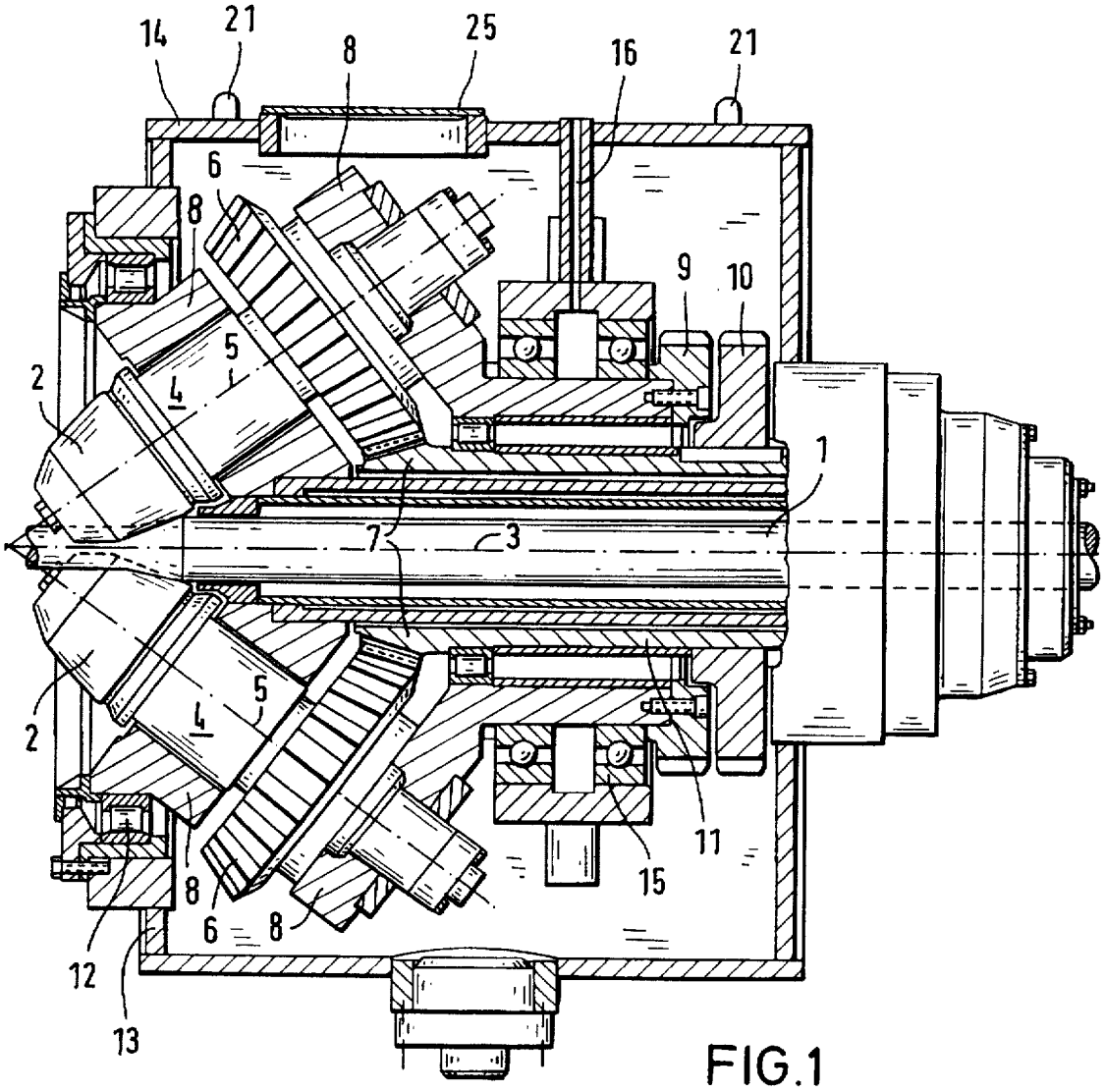
FIG. 1 is a view showing a longitudinal section of an arrangement for inclined rolling tube and bar-shaped rolling articles in accordance with the present invention.

FIG. 1 shows an arrangement for inclined rolling of bar-shaped rolling articles 1 in accordance with the present invention. The rolling article 1 can also be formed as a tubular article. The arrangement has a plurality of rollers 2 which reduce the cross-section of the rolling article. In particular this is performed by rolling of the rollers 2 on the rolling article 1 and simultaneously rotating about the longitudinal axis 3 of the rolling article. In the shown embodiment four rollers 2 are provided. Only two rollers 2 can be seen in FIG. 1.

The rollers 2 are mounted floatingly on roller shafts 4. The roller axes 5 of the roller shafts 4 are inclined to the rolling article longitudinal axis 3. Drive bevel gears 6 are arranged on the roller shafts 4 and connected with them for joint rotation. The drive bevel gears 6 engage with a sun gear 7. The roller shafts 4 are supported rotatably in a rotor 8. The rotor is driven through a toothed gear 9 provided with end teeth from a not shown pinion and also a not shown motor. A toothed gear 10 is separately driven by a second not shown motor and pinion. It is connected with a bushing-shaped extension 11 of the sun gear 7 so as to rotate together with latter and drive the sun gear.

As can be seen from FIG. 1, the rotor 8 is supported in an end wall 13 of a stationary housing 14 through a roller bearing 12. In particular, an end portion of the rotor 8, which faces the rollers 2 is supported in the end wall. The opposite end portion of the rotor 8 which faces away from the roller 2, is supported through a bearing 15 in another wall 16 of the housing 14, which is formed as an intermediate wall or partition.

Figure 2:
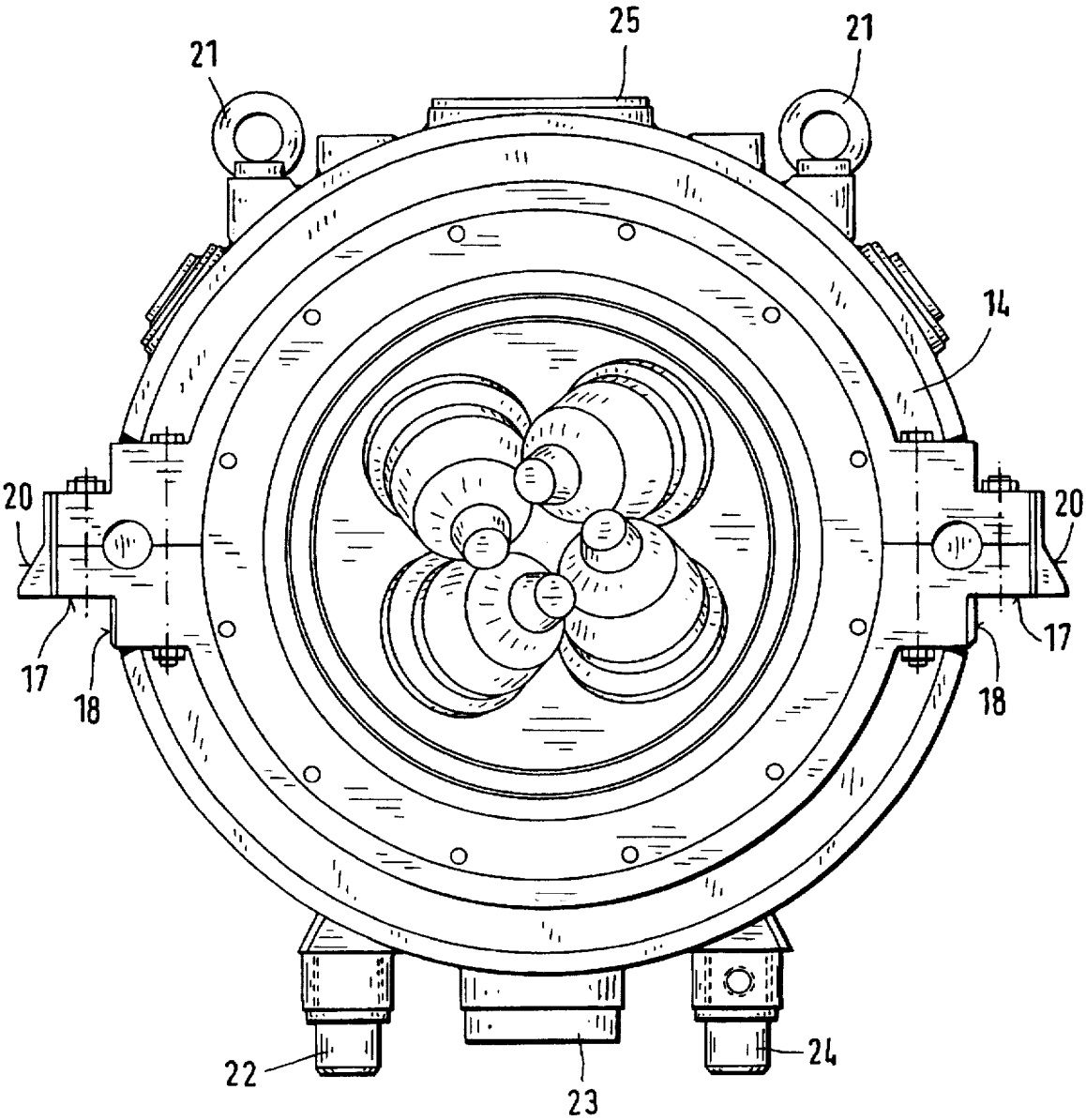
FIG. 2 is a view showing the inventive arrangement of FIG. 1 for inclined rolling of tube and bar-shaped rolling articles in a front view.
Figure 3:
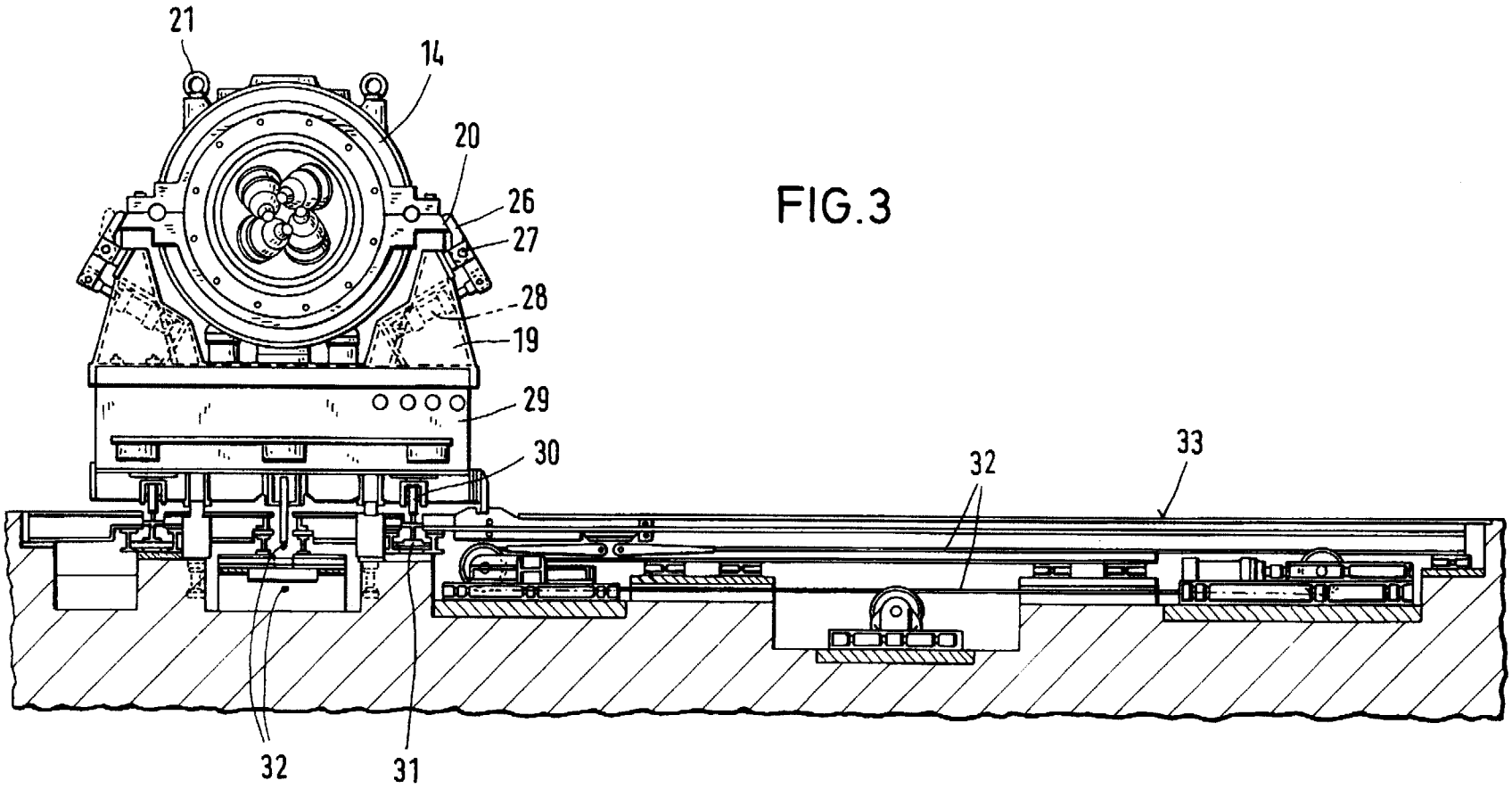
FIG. 3 is a view showing the inventive arrangement for rolling of tube and bar-shaped rolling articles of FIGS. 1 and 2 with an exchange car.

Moreover, as can be seen from FIG. 1, the housing 14 is closed from all sides and exposes the rollers 2 only at one end side. It can be seen from FIG. 2 how the arrangement with four rollers 2 is formed. The housing 14 is provided with receiving surfaces 17 and oriented surfaces 18 at its both sides, and with these surfaces it is inserted in a base 19 and oriented in it as shown in FIG. 3. Clamping surfaces 20 serve for clamping the housing 14 and the base 19. Suspending devices 21 that is for example ring screws, allow an unobjectionable suspension of the housing 14 for example on a girder crane. The housing 14 also has an oil supply 22, and oil discharge 23 and a water supply 24 shown in FIG. 2. They are tightly connectable with corresponding tubular conduits in the base 19 from outside. A housing cover 25 provides an access to the inner components of the arrangement.

FIG. 3 shows the housing 14 inserted in the base 19. Clamping members 26 are supported in hinges 27 and press, by cylinder-piston units 28, against the clamping surfaces 20 so as to fixedly connect the housing 14 with the base 19.

Figure 4:
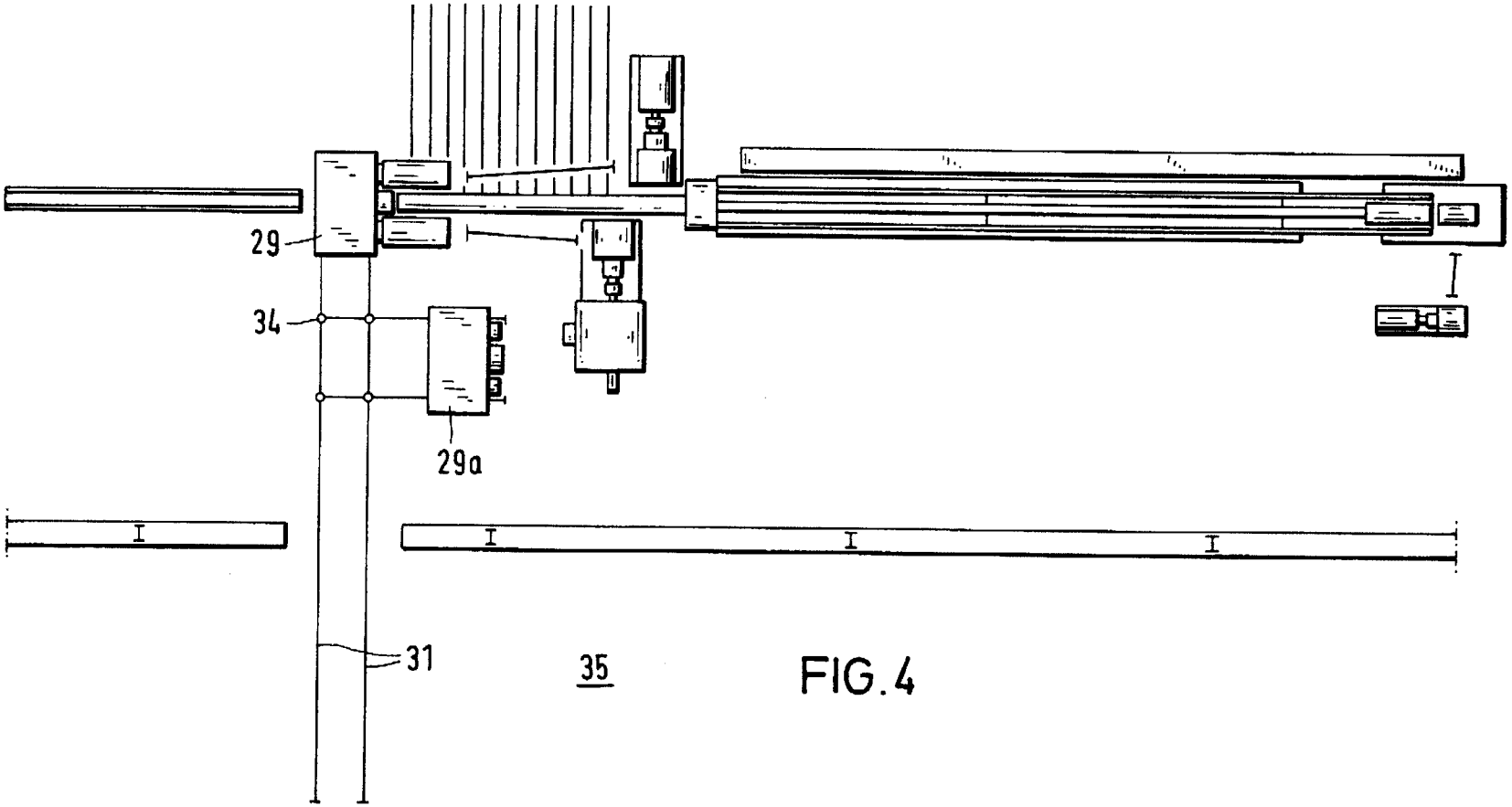
FIG. 4 is a plan view of the inventive arrangement for inclined rolling of tube and bar-shaped rolling articles.

The base 19 is arranged on an exchange car 29 and fixedly connected with it by screws. It is however possible to form the base 19 in the exchange car 29 as a one-piece structure. The exchange car 29 has wheels 30 running on rails 31. Cables 32 are arranged under the floor 33 and can be driven by a motor so as to drive the exchange car 29 in rolling article longitudinal direction and transversely to it, in correspondence with the arrangement of the rail 31. For this purpose the wheels 30 are arranged on the exchange car 29 rotatably about a vertical axis. The rotation of the wheels 30 is performed in the region of rotary plates 34 which are arranged in the intersecting points of the rails 31, as shown schematically in FIG. 4. In the device shown there, one exchange car 29*a* is located in the region of the rolling line and therefore in the operational position, while a second exchange car 29*b* is prepared for use and waits near the rolling line. Where roller wear occurs or rolling article 1 with other dimensions must be rolled, the exchange car 29 can be removed from the rolling line and driven on the rollers 31 to a workstation 35, where it is prepared for a future use. The second exchange car 29*a* can be driven to the rolling line, where after a short exchange time, it can perform its operation.

It will be understood that each of the elements described above, or two or more together, may also find a useful application in other types of constructions differing from the types described above.

While the invention has been illustrated and described as embodied in an arrangement for inclined rolling of tubes and bar-shaped rolling articles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for inclined rolling of tube-and bar-shaped rolling articles, comprising at least two driven rotatable rollers arranged so that they rotate about the longitudinal axis of a rolling article; a rotatable rotor arranged so that it surrounds the rolling article and supports said rollers; and a stationary housing which is closed from all sides and exposes said rollers only in an end side region, said rotor being arranged inside said housing and rotatably supported in said housing.

2. An arrangement as defined in claim 1, wherein said housing is provided with openings, said rotor being rotatably supported in said openings of said housing.

3. An arrangement as defined in claim 1; and further comprising drive means for driving said rotor; and drive means for driving said rollers, said drive means for driving said rotor and said drive means for driving said rollers being arranged inside and surrounded by said housing.

4. An arrangement as defined in claim 1; and further comprising a base, said housing having placing surfaces, orienting surfaces and clamping surfaces with which it is insertable into said base so that said housing is orientable relative to a rolling line and fixedly clamped with said base.

5. An arrangement as defined in claim 1, wherein said housing is provided with suspension devices for suspension of a crane and is transportable by the crane.

6. An arrangement as defined in claim 1; and further comprising a base, said housing being insertable in said base, said base being formed as movable exchange car movable together with said housing toward a rolling line and away from a rolling line.

7. An arrangement as defined in claim 1; and further comprising a base formed as a movable exchange car, said housing being insertable in said base, said base together with said housing being movable toward a rolling line and away from a rolling line.

8. An arrangement for inclined rolling of tube-and bar-shaped rolling articles, comprising at least two driven rotatable rollers arranged so that they rotate about the longitudinal axis of a rolling article; a rotatable rotor arranged so that it surrounds the rolling article and supports said rollers; and a housing which is closed fro mall sides and exposes said rollers only in an end side region, said rotor being arranged inside said housing and rotatably supported in said housing, said housing having an end wall and another wall, said rotor having an end portion facing toward said rollers and rotatably supported in said end wall of said housing, and another end portion facing away from said roller and rotatably supported in the another wall of said housing.

* * * * *